United States Patent [19]

Stewart

[11] 4,147,490

[45] Apr. 3, 1979

[54] POWDER COMPACTING PRESSES

[75] Inventor: Roy Stewart, Blackpool, England

[73] Assignee: British Nuclear Fuels Ltd., Warrington, England

[21] Appl. No.: 823,195

[22] Filed: Aug. 9, 1977

[30] Foreign Application Priority Data

Aug. 13, 1976 [GB] United Kingdom ..... 33874/76

[51] Int. Cl.[2] ..... B30B 11/04

[52] U.S. Cl. ..... 425/355; 425/107; 425/DIG. 115; 425/DIG. 35

[58] Field of Search ..... 425/78, 354, 355, DIG. 115, 425/107, 450.1, DIG. 221, DIG. 222, DIG. 223

[56] References Cited

U.S. PATENT DOCUMENTS

| | | | |
|---|---|---|---|
| 1,599,873 | 9/1926 | Caldwell | 425/DIG. 115 |
| 2,404,559 | 7/1946 | Ashbaugh | 425/354 X |
| 2,431,095 | 11/1947 | Tucker | 425/355 X |
| 3,132,379 | 5/1964 | Crane | 425/DIG. 115 |
| 3,366,368 | 1/1968 | Hibbing | 425/355 X |
| 3,676,030 | 7/1972 | Roepenack et al. | 425/78 |

*Primary Examiner*—J. Howard Flint, Jr.

*Attorney, Agent, or Firm*—Larson, Taylor and Hinds

[57] ABSTRACT

A press for compacting powders in which a first plunger is moved into a stationary die to meter and charge powder to be compacted into the die from one end of the die, the first plunger and a second plunger are advanced to compact the powder within the die and the first plunger is then used to push the compacted powder from the other end of the die.

The press may be used to make pellets of ceramic nuclear fuel material.

7 Claims, 6 Drawing Figures

POWDER COMPACTING PRESSES

BACKGROUND TO THE INVENTION

This invention relates generally to presses for compacting powder into shapes, and particularly but not exclusively to such presses for the compaction of ceramic nuclear fuel powder into pellets which are to be stacked in sealed containers forming part of nuclear fuel assemblies for nuclear reactors.

Although commercially available powder presses can be adapted for use with ceramic nuclear fuel powder, it has proved difficult to provide against loss of powder due to the fact that the compacts are removed from the press dies in a direction against the inward flow of powder, necessitating complicated die filling devices such as shoes or sweep arms which are difficult to seal against loss of feed powder. Most commercial presses are used for confectionery or with other common and inexpensive powders so that some loss of powder is acceptable, but where the powder is a fissile ceramic material, particularly one containing plutonium, any loss of powder is to be avoided, on cost, safety and security grounds.

Commercial presses fall into two general kinds, the mechanical press, with its set stroke, and the hydraulic. The mechanical kind provides compacts of constant depth but green density is variable unless constant fill is effective, and this requires very expensive metering mechanism. The hydraulic press enables a close control over green density, but this is at the expense of constant depth unless the said expensive constant fill is provided. Because constant green density is important so that subsequent diameter grinding after sintering is reduced or eliminated, hydraulic pressing is necessary to compensate for die fill variation. Other variants affecting green density are intergranular and die-wall friction, and entrapped air. Intergranular friction has a small effect on green density variation compared with die wall friction but often granules are lubricated to provide the die wall lubrication required. Die wall lubrication separately is a much more economical operation and does not introduce contaminants into the granules. Provided the depth/diameter ratio is not too large and if ample time is allowed for a compaction cycle, variations of green density due to entrapped air can also be reduced to negligible proportions. By reducing or eliminating green density variation, diameter grinding, which is expensive and time consuming, can be reduced or eliminated.

SUMMARY OF THE INVENTION

It is therefore an object of the present invention to provide a powder compacting press not subject to the difficulties and shortcomings set forth in the preceding paragraphs.

According to the invention, a press for compacting powder comprises a stationary die, a support member movable relative to the stationary die, a first plunger mounted on the support member on the same axis as the die and capable of being moved into and through the die as the support member is moved relative to the die, a second plunger mounted on the support member on the same axis as the first plunger and capable of being moved into the die, means for feeding powder to be compacted to one end of the die, means for moving the support member so that the first plunger advances into the die to meter and charge the powder to be compacting into the die from said one end of the die, means for advancing the first and second plungers to compact the powder within the die, and means for further moving the support member so that the first plunger is advanced through the die to eject the compacted powder from the other end of the die.

The means for advancing the first and second plungers to compact the powder may comprise a first hydraulic ram mounted on the support member for advancing the first plunger and a second hydraulic ram mounted on the support member on the same axis as the first hydraulic ram for advancing the second plunger. The support member may be carried on parallel slides with a third hydraulic ram moving the support member in the slides to provide the moving means for the support member and a fourth hydraulic ram providing the further moving means for the support member.

The means for feeding powder to one end of the die may comprise a hopper in which the powder is stored, a feed chamber below the hopper, the volume of the feed chamber being adjustable to vary the amount of powder which is to be compacted. The hopper may be provided with a homogeniser for the powder.

The die is preferably lubricated once during each operating cycle. The press may therefore further comprise an absorbent ring fitted around the second plunger, a reservoir containing a die lubricant so placed that the ring is charged with lubricant when the second plunger is in a fully retracted position, the lubricated ring lubricating the die as the second plunger passes into the die.

When the press is being used to compact powders of ceramic nuclear fuel material egress of powder from the press is undesirable. Accordingly the plungers are provided with sealing means and flexible members connect the stationary die to the moving parts of the press to present egress of powder.

BRIEF DESCRIPTION OF THE DRAWINGS

A constructional example of a press according to the invention will now be described with reference to the accompanying drawings, in which.

DETAILED DESCRIPTION OF A PREFERRED EMBODIMENT

Figure 1:
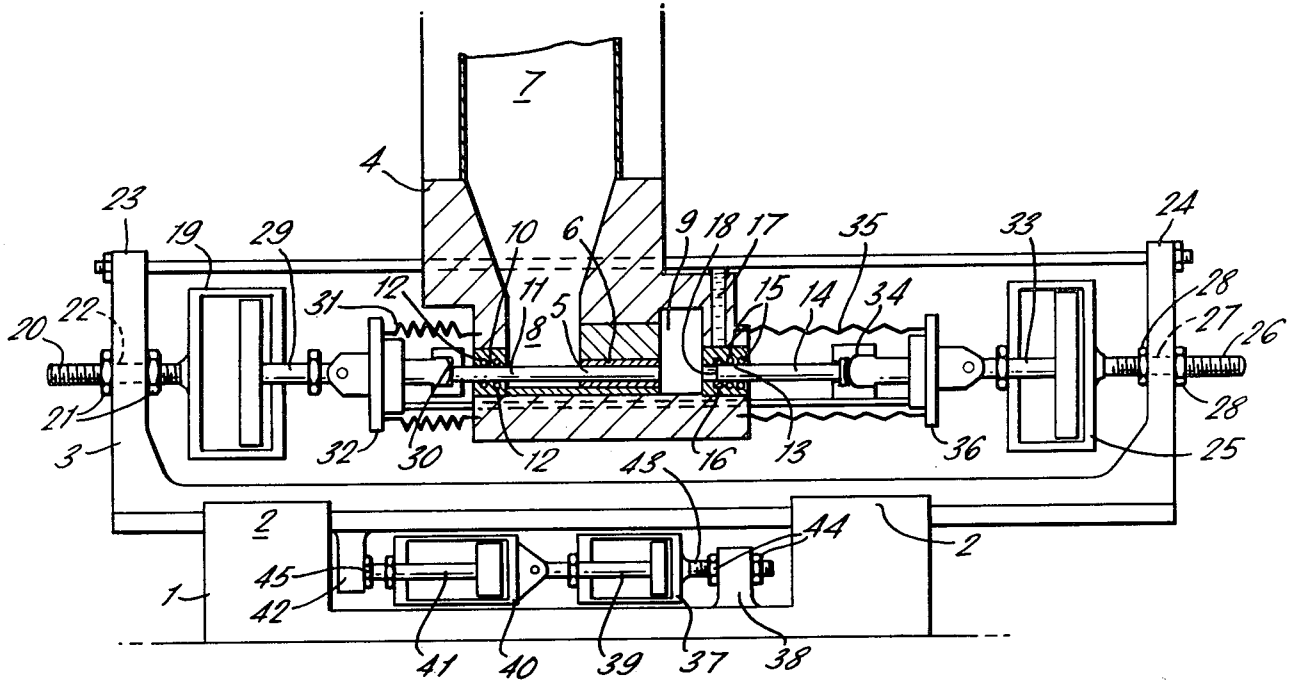
FIG. 1 is a side view partly in medial section of a powder compacting press.
Figure 2:
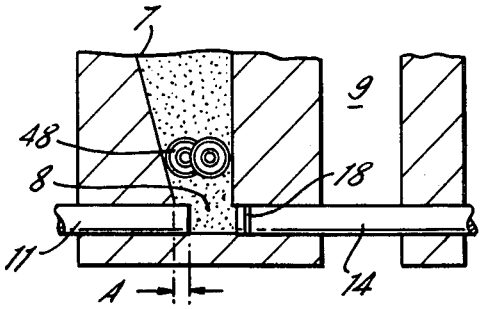
FIGS. 2–6 are diagrammatic views each illustrating a step in an operating cycle of the press shown in FIG. 1.

Referring firstly to FIG. 1 of the drawings, this illustrates a press for the compaction of powder into compacts. The particular embodiment shown is for a press suitable to provide right cylindrical compacts, termed pellets in the art, from ceramic nuclear fuel powder, eg uranium dioxide ($UO_2$) or mixed oxides, eg $UO_2$ plus plutonium dioxide ($PuO_2$). The press consists of a bed plate 1 carrying in parallel slides 2 a yoke 3. There is a die block 4 mounted so as to be immovable, as is also the bed plate 1. The die block 4 has a cylindrical die 5 formed by a tubular insert 6 of a hard material such as tungsten carbide removably supported in the die block 4. The latter also has a hopper 7 supplying a feed chamber 8 at one end of the die 5 and communicating therewith, and a pellet-removing zone 9 at the other end of the die, from which formed pellets disengaged from the die can fall out of alignment with the die axis and then be removed to a store (not shown), so as not to interfere with the formation of subsequent pellets.

The die block 4 also has a bearing aperture 10 for a plunger 11 which can slide so as to pass into and through the feed chamber 8, into and through the die 5, and into the zone 9. There is a pair of sealing '0' rings 12 in the aperture 10 for the plunger 11. The die block 4 also has a bearing aperture 13 for a plunger 14 and a pair of sealing '0' rings 15 for the plunger 14, the latter being slidable to occupy various positions within the die 5, the zone 9 and the aperture 13. The aperture 13 also has a lubricant reservoir 16 fed from an inlet 17 and serving to charge an absorbant ring 18 on the plunger 14 as the ring registers with the reservoir 16 (see FIG. 6 and subsequent description).

The yoke 3 carries a ram 19, the ram 19 being on the same axis as the die 5, the plungers 11, 14 and the apertures 10, 13 and being axially adjustable for setting up purposes by means of a screwthreaded stud 20 extending through an aperture 22 in one arm 23 of the yoke 3, and secured by nuts 21. The other arm 24 of the yoke 3 is similarly provided with an axially adjustable ram 25 on the same axis as the ram 19 and similarly possessing a screwthreaded stud 26 extending through an aperture 27 in the arm 24 and secured by nuts 28. The piston rod 29 of the ram 19 is secured by a demountable coupling 30 to the plunger 11, and bellows 31 sealed at one end to the die block 4 and at the other end to a part 32 of the ram 19/plunger 11 assembly, serves to contain against any leakage of valuable and/or environment-risk powder from the feed chamber 8 which may escape the '0' rings 12. Similarly, the piston rod 33 of the ram 25 is secured by the demountable coupling 34 to the plunger 14, and bellows 35 sealed at one end to the die block 4 and at the other end to a part 36 of the ram 25/plunger 14 assembly, fulfils the same purpose as bellows 31.

The bed plate 1 has a ram 37 secured to a lug 38 of the bed plate 1 and the piston rod 39 of the ram 37 is secured to another ram 40 whose piston rod 41 is secured to a lug 42 on the yoke 3. The ram 37 has a screwthreaded stud 43 and nuts 44 enabling it to be set up in correct disposition, and the piston rod 41 of the ram 40 has its end region screwthreaded, such end being screwed into lug 42 and secured in desired axial position on setting up, by a nuts 45, one only being visible.

It will be appreciated that by operating the rams 19, 25, 37 and 40 (each ram being a two-position ram, referred to subsequently as 'retracted' or 'advanced', as appropriate) in particular sequences, the plungers 11 and 14 can be made to occupy various positions both in the die block 4 and in relation to each other. An operational sequence will now be described, having reference not only to FIG. 1 but also to FIGS. 2–6, the latter illustrating five steps in the operating sequence.

Firstly, ram 19 is retracted, ram 25 is retracted, ram 37 is advanced and ram 40 is advanced. This places the plungers 11 and 14 in the positions shown in FIG. 2, where plunger 11 is to the side of feed chamber 8, enabling powder from hopper 7 to fill the chamber 8, and plunger 14 is occupying nearly all of die 5. In this position, axial position of the plunger 11 can be adjusted by a small amount to vary the amount of powder which is taken for compaction. This adjustment is generally made for a whole run, not between sequences unless the compacts are out of tolerance. The amount of adjustment is illustrated by 'A' in FIG. 2.

Figure 3:
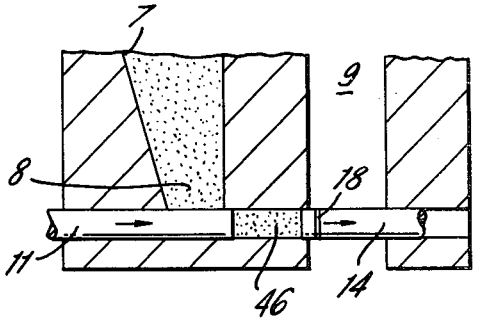

The next step is for the ram 37 to be retracted, with the other rams holding their positions. This serves to move the plunger 11 into the die 5, driving the charge of powder 46 before it, and to move the plunger 14 nearly out of the die 5, but with the same distance between the plungers as in step one. This is shown in FIG. 3.

Figure 4:
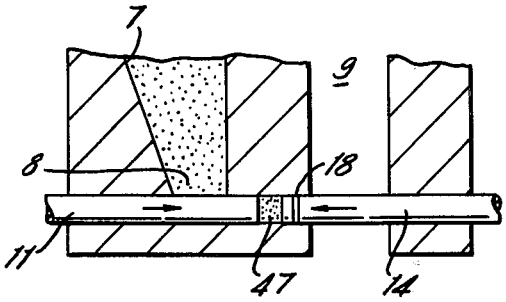

The succeeding step is for ram 19 to be advanced simultaneously with ram 25 being advanced, whilst rams 37 and 40 hold their position. This causes the plungers 11 and 14 to move towards each other, compacting the power charge 46 into a pellet 47. This is shown in FIG. 4.

Figure 5:
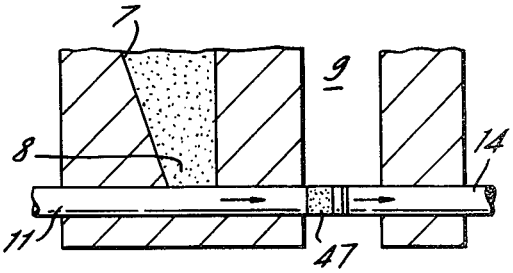
Figure 6:
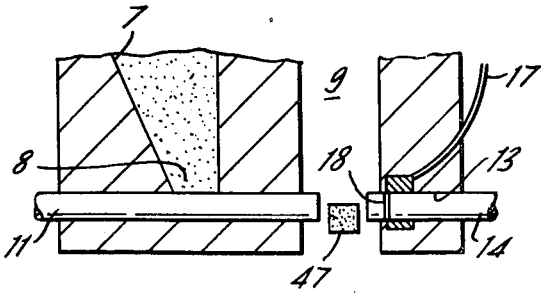

The compacted pellet 47, as shown in FIG. 5, is then ejected into the pellet collecting zone 9 by operating ram 40 to retract it. Initially ram 25 is kept advanced so as to continue to grip the pellet 47 whilst ejecting it, but on completion of the retraction of ram 40, ram 25 is retracted, releasing the grip on pellet 47 and allowing it to fall away in zone 9. This is shown in FIG. 6. The last ram movement also serves to retract the plunger 14 to the extent of its absorbant ring 18 registering with die lubricant reservoir 16.

Finally, ram 19 is retracted, and rams 37 and 40 are advanced, which moves the plungers 11 and 14 back to the positions they occupied at the beginning of the sequence, at the same time lubricating the die 5 as the ring 18 moves through it. The sequence is then repeated.

A homogeniser 48 (shown only in FIG. 2) can be provided if desired, to assist in giving uniform powder conditions.

The plungers 11, 14 preferably have their ends tipped with a hard material such as tungsten carbide. These are made replaceable. Furthermore it can be arranged that the die insert 6 is ejectable into the hopper 7 for replacement purposes.

The use of one of the plungers to meter and charge the powder to be compacted into the die and the use of hydraulic pressing to compact the powder facilitates the manufacturer of pellets having little or no variation in green density.

Separation of feed and products, and containment of compacting operations, well separated from the hydraulic system, are particular features of the press according to the invention.

We claim:

1. A press for compacting powder in a die comprising a stationary die, a support member movable relative to the stationary die, a first plunger mounted on the support member on the same axis as the die and capable of being moved into and through the die as the support member is moved relative to the die and also being movable along said axis relative to the support member, a second plunger mounted on the support member on the same axis as the first plunger and capable of being moved along said axis relative to the support member, means for feeding powder to be compacted to one end of the die, means for moving the support member with the first plunger stationary relative to the support member so that the first plunger advances into the die to meter and charge the powder to be compacted into the die from said one end of the die, means for advancing the first and second plungers relative to the support member to compact the powder within the die, and means for further moving the support member with the first plunger stationary relative to the support member so that the first plunger is advanced through the die to eject the compacted powder from the other end of the die.

2. A press for compacting powder as claimed in claim 1 wherein the means for advancing the first and second plungers to compact the powder comprise a first hydraulic ram mounted on the support member for advancing the first plunger and a second hydraulic ram mounted on the support member on the same axis as the first hydraulic ram for advancing the second plunger.

3. A press for compacting powder as claimed in claim 2 wherein the support member is carried on parallel slides and a third hydraulic ram moves the support member in the slides to provide the moving means for the support member, and a fourth hydraulic ram provides the further moving means for the support member.

4. A press for compacting powder as claimed in claim 1 wherein the means for feeding powder to one end of the die comprises a hopper in which the powder is stored, a feed chamber below the hopper, the volume of the feed chamber being adjustable to vary the amount of powder which is to be compacted.

5. A press for compacting powder as claimed in claim 4 wherein a homogeniser for the powder is provided within the hopper.

6. A press for compacting powders as claimed in claim 1 further comprising an absorbent ring fitted around the second plunger, and a reservoir containing a die lubricant so placed that the ring is charged with lubricant when the second plunger is in a fully retracted position, the lubricated ring lubricating the die as the second plunger passes into the die.

7. A press for compacting powders as claimed in claim 1 wherein the plungers are provided with sealing means and flexible members connect the stationary die to the moving parts of the press to prevent egress of powder.

* * * * *